United States Patent [19]

Bell et al.

[11] 3,938,989

[45] Feb. 17, 1976

[54] ARSENIC REMOVAL FROM NICKEL MATTE

[75] Inventors: Malcolm Charles Evert Bell, Sudbury; Ramamritham Sridhar, Mississauga, both of Canada

[73] Assignee: The International Nickel Company, Inc., New York, N.Y.

[22] Filed: June 24, 1974

[21] Appl. No.: 482,250

[30] Foreign Application Priority Data

July 5, 1973 Canada ..... 175759

[52] U.S. Cl. ..... 75/82; 75/6; 423/88; 423/509

[51] Int. Cl.[2] ..... C22B 23/00

[58] Field of Search ..... 75/82, 6, 7, 8, 82, 87, 75/88, 509; 423/87, 88, 491, 509, 568

[56] References Cited

UNITED STATES PATENTS

| | | | |
|---|---|---|---|
| 3,220,796 | 11/1965 | Epinosa | 423/88 |
| 3,288,561 | 11/1966 | Mellgren et al. | 423/509 |
| 3,466,167 | 9/1969 | Illis et al. | 423/150 |

*Primary Examiner*—M. J. Andrews
*Attorney, Agent, or Firm*—Miriam W. Leff; Ewan C. MacQueen

[57] ABSTRACT

Nickel matte containing at least about 28% sulfur is refined with respect to arsenic, antimony or bismuth by contacting molten matte with gaseous chlorine to chlorinate and volatilize arsenic, antimony or bismuth from the nickel matte. Advantageously, the molten nickel matte is provided with a halide flux to minimize volatilization of any nickel chloride that is formed.

20 Claims, No Drawings

ARSENIC REMOVAL FROM NICKEL MATTE

The present invention pertains to the purification of nickel matte, and more particularly to the pyrorefining of nickel matte.

Arsenic is very difficult to remove from nickel matte, molten nickel, and nickel metal. For example, in converting nickel matte to molten nickel by surface blowing a turbulent bath with a free-oxygen-containing gas at temperatures as high as 1650°C., essentially all the arsenic reports in the nickel metal product. Little, if any, arsenic is eliminated even when molten nickel is subjected to subatmospheric pressures of 0.0001 atmosphere at temperatures as high as 1600°C. or even higher, whether or not the molten nickel is saturated with nickel oxide.

It has been suggested that arsenic be removed from molten nickel by fluxing with slags containing sodium compounds. Although this process can eliminate some arsenic, the process requires the use of large quantities of sodium-containing flux materials and the resulting flux is highly corrosive to commonly employed refractories.

Recently it has been suggested that molten nickel matte be purified by treatment with a fused chloride salt containing nickel chloride or by injecting chlorine into nickel matte having a cover of a fused chloride salt. Although the practice of this process dramatically lowers the content of impurities such as cobalt, copper, iron, lead, tin and zinc, the arsenic content of the nickel matte, however, is essentially unaffected by this treatment. Upon blowing the thus-purified nickel matte with a free-oxygen-containing gas in a top-blown rotary converter, a nickel metal product containing 0.1% arsenic, or more, is obtained. Such arsenic contents are unacceptable for many applications.

It has now been discovered that arsenic, antimony and bismuth can be eliminated from nickel matte by chlorination while controlling the sulfur content of the matte.

Generally speaking, the present invention contemplates a process for refining nickel matte. The process comprises establishing a molten bath of nickel matte containing at least one impurity selected from the group consisting of arsenic, antimony, bismuth, selenium, and tellurium and at least about 28% sulfur and contacting the nickel matte with gaseous chlorine which reacts with the impurity to form a chloride that is volatilized from the nickel matte.

As noted hereinbefore, it has been proposed to chlorinate nickel matte to lower the cobalt, copper, iron, lead, tin and zinc contents. The elimination of cobalt, copper and iron is facilitated by treating sulfur deficient nickel mattes, i.e., mattes in which the sulfur content is lower than the stoichiometric amount required to form the compounds $Ni_3S_2$, $Cu_2S$, $Co_9S_8$ and FeS with the nickel, copper, cobalt and iron in the melt. For example, over 80% of the copper associated with a nickel matte containing 21% sulfur can be eliminated by chlorination but under similar chlorination conditions only 20% of the copper is eliminated from a nickel matte containing 32% sulfur. Arsenic elimination by chlorination, on the other hand, is effective only when treating mattes containing at least about 28% sulfur. As shown hereinafter, the arsenic content of nickel mattes is substantially unaffected by the chlorination treatment when the sulfur content of the matte is below about 25%. The effectiveness of the chlorination treatment with regard to arsenic, antimony, or bismuth elimination increases with increasing sulfur contents up to about 35% sulfur, at which sulfur level the sulfur vapor pressure increases and is lost from the matte. It should be noted that material amounts of cobalt, copper, iron, lead, tin and zinc are removed along with arsenic, antimony, bismuth, selenium, and tellurium, particularly when a salt cover is employed. From the standpoint of degree of refining, operating temperatures and minimization of nickel losses by volatilization of nickel chloride from the salt, it is advantageous to treat nickel mattes containing between about 30% and 32.5% sulfur. Nickel mattes that contain, after sulfur adjustment, if required, between about 42% and 71% nickel, up to about 5% cobalt, up to about 5% copper, up to about 5% iron, up to about 5% lead, up to about 5% zinc, between about 0.01% and 3.0%, each, of antimony, arsenic, bismuth, selenium, and tellurium and between about 30% and 32.5% sulfur are advantageously treated by the process in accordance with the present invention. The above-described materials can be obtained by smelting ores, ore concentrates, nickel sulfide precipitated from aqueous solutions and other metallurgical intermediates including sulfided oxide ores, scrap, or reduction smelted and/or sulfided process dusts, with provisions being made for sulfur adjustment.

Advantageously, the process in accordance with the present invention is used to lower the arsenic content of converter mattes, i.e., the matte product derived from slagging iron in top blown or conventional converters. Converter matte is frequently sulfur deficient, containing as little as about 20% sulfur or less. In most instances, converter matte contains between about 20% and 25% sulfur, a total impurity content, including antimony, arsenic, bismuth, selenium, and tellurium, of up to about 10%, and the balance essentially nickel. The converter matte is advantageously first chlorinated with a fused salt cover to efficiently remove a preponderant part of the impurities other than arsenic, antimony, bismuth, selenium or tellurium. During the initial chlorination treatment, the sulfur content of the matte is increased by as much as 3% which materially lowers the amounts of sulfur which must be added to the matte to increase the sulfur content to at least about 28% for arsenic removal. The sulfur content of converter matte can be adjusted to at least about 28% sulfur by introducing elemental sulfur or hydrogen sulfide to molten nickel matte while maintaining an ambient atmosphere above the bath that is non-oxidizing to nickel sulfide. It should be noted that when treating nickeliferous sulfide precipitates, which contain about 35% sulfur, there is no need to resort to sulfur adjustment.

Even though refining proceeds by volatilization, it is advantageous to employ a fused halide salt cover in order to minimize volatilization of nickel chloride which dissolves readily in fused halide fluxes. The fused halide salt cover is formed of at least one chloride salt of at least one metal selected from the group consisting of alkali metals or alkaline earth metals, provided that the salt is molten at chlorination temperatures. Most advantageously, the fused salt cover contains at least two different salts in order to provide a salt cover that fuses at lower temperatures. Examples of useful salt covers, although the invention is not limited thereto, include solutions of equal parts of at least two chlorides of elements selected from the group consisting of sodium, potassium, lithium and calcium.

The relative amounts of fused salt to nickel matte can vary over wide ranges, particularly when chlorinating with gaseous chlorine. In most instances, however, the weight ratio of salt to matte is between about 1:20 and 2:1 in order to minimize heat requirements for fusing and keeping the salt cover at temperature while insuring that sufficient salt is present to dissolve and retain any nickel chloride generated during chlorination. Most advantageously, the weight ratio of salt to matte is between about 1:20 and 1:1 in order to optimize overall process efficiency.

Chlorination can be conducted at any temperature above the liquidus temperature of the nickel matte. Elimination of antimony, arsenic, bismuth, selenium, or tellurium is favored by high temperatures but nickel losses, heat requirements, and materials considerations put a practical upper limit of about 1000°C. at which the process can be economically conducted. In terms of reaction rates, completeness of reaction, heat requirements, materials considerations and nickel losses, chlorination is conducted at temperatures between about 750°C. and 1000°C. and advantageously between about 800°C. and 900°C.

Efficient arsenic, antimony, bismuth, selenium, and tellurium elimination is achieved by insuring good contact between the chloridizing reagent and the nickel matte. The agitation provided by gaseous chlorine, particularly when an inert carrier gas, such as nitrogen, carbon monoxide, argon and carbon dioxide is used, provides excellent gas-liquid and liquid-liquid contact promoting chlorination of the arsenic and other chlorinatable impurities in the nickel matte. Agitation, whether pneumatic or mechanical, besides providing good liquid-liquid and/or gas-liquid contact also aids in nucleation and expulsion of gaseous arsenic, antimony, bismuth, selenium, and tellurium chlorides from the system.

The process in accordance with the present invention is effective in lowering the arsenic, antimony, bismuth, selenium and tellurium contents to less than about 0.01% from about 3% or more. When the arsenic, antimony, bismuth, selenium and tellurium contents of the nickel matte have been lowered to predetermined levels, the nickel matte can be directly converted to nickel metal by surface blowing oxygen or the sulfur content can be lowered to below about 20% for further chlorination to chlorinate and remove other impurities, such as copper, cobalt, iron, lead and zinc, depending upon whether or not the original nickel matte contained these impurities.

The fused salt cover can be continuously or intermittently removed and treated to recover nickel and any other chlorinated metal values. Recovery of nickel and other chlorinated metal values can be effected by cooling, dissolving the salt in water and recovering the metals from solution, by electrolyzing the fused salt or by precipitating the chlorinated metals from the salt with known precipitants. The latter two processes are preferred because the salt is regenerated for reuse while the metals are being recovered, thereby making the overall process economically more attractive.

In an advantageous embodiment of the process in accordance with the present invention countercurrent techniques are employed. During the chlorination and volatilization of antimony, arsenic, bismuth, selenium, or tellurium, material amounts of nickel are also chlorinated but the less volatile chlorinated nickel values are dissolved and retained in a fused salt cover. When the nickel chloride concentration reaches predetermined levels, e.g., about 10%, the salt cover can be conveyed to a sulfur-deficient matte, e.g., nickel matte containing between about 20% and 25% sulfur, purification stage in which the sulfur-deficient matte is contacted with the nickel chloride-containing salt to chloridize and extract into the salt impurities, such as cobalt, copper, iron, lead, tin and zinc. The molten salt containing the chloridized impurities is, after removal from the sulfur-deficient matte, stripped of the chloridized impurities by precipitation, by electrolysis or by chemical addition, such as magnesium. The stripped salt is returned to the arsenic, antimony, bismuth, selenium, or tellurium elimination stage where during the elimination of these impurities it is recharged with nickel chloride and thus readied for further refining of the sulfur-deficient matte. The sulfur content of the refined sulfur-deficient matte can, either in a separate step or before chlorination to chlorinate and volatilize antimony, arsenic, bismuth, selenium, or tellurium, be adjusted to a minimum level of about 28% as described hereinbefore. After chlorination and volatilization of antimony, arsenic, bismuth, selenium, or tellurium, the nickel matte can then be converted to nickel metal by blowing with a free-oxygen-containing gas.

In order to give those skilled in the art a better understanding of the process in accordance with the present invention and the advantages flowing from the practice thereof, the following illustrative examples are given:

EXAMPLE I

Equal weights of a nickel matte containing 0.021% arsenic, 30.8% sulfur and the balance essentially nickel and a salt mixture of equal parts of sodium chloride and potassium chloride were heated to 800°C. Gaseous chlorine was passed through the nickel matte. Samples of the nickel matte were intermittently withdrawn at different chlorine additions and were analyzed for sulfur and arsenic contents. The results are shown in Table I, which results confirm that under the conditions of the process in accordance with the present invention the arsenic content of nickel matte can be lowered to commercially acceptable levels.

For comparative purposes, a test was conducted under similar conditions with the exception that the matte initially contained only 21% sulfur. After chlorine in amount equivalent to 0.18 kilogram per kilogram of matte was passed through the matte, the arsenic content of the matte actually increased to 0.051% from 0.042% while the copper, cobalt and iron contents were lowered to 0.14%, 0.02%, and 0.04% from 0.86%, 0.59% and 0.14%, respectively. This test confirms that arsenic cannot be removed from sulfur deficient matte by chlorination while copper, cobalt and iron are readily removed by chlorination of suflur-deficient mattes.

Another test was conducted on a nicke matte containing 0.14% arsenic and 32% sulfur to show that arsenic is eliminated by chlorination and not be mere volatilization. Equal weights of matte and a salt mixture of equal parts of sodium chloride and potassium chloride were heated to 800°C. while nitrogen was bubbled through the matte. After 90 minutes the arsenic content had increased to 0.16%. This test confirms that arsenic is eliminated by chlorination.

TABLE I

| Chlorine Injected Kgm $Cl_2$/Kg Matte | | Matte Analysis % Ni | % S | % As | Salt Analysis % Ni | % As |
|---|---|---|---|---|---|---|
| Initial Matte | 0.0000 | 68.0 | 30.8 | 0.021 | 0.0 | 0.0 |
| | 0.0568 | | 32.2 | 0.013 | 2.6 | |
| | 0.1070 | | 32.0 | 0.006 | 4.9 | |
| | 0.1600 | | 33.0 | 0.002 | 6.9 | |
| | 0.212 | | 32.6 | <0.001 | 8.8 | |
| | 0.319 | | 32.6 | <0.001 | 11.9 | <0.001 |

EXAMPLE II

Three parts of a nickel matte having the analysis given in Table II and one part of a salt mixture of equal parts of sodium chloride and potassium chloride were heated to 815°C. and gaseous chlorine in an amount equivalent to 0.174 kilogram per kilogram of matte was passed through the matte. The analyses of the final matte and the final salt are given in Table II. The arsenic content was lowered to less than 0.002%. In addition to showing that mattes having high arsenic contents can be treated, this example also confirms the relative insensitivity of arsenic removal to the amount of salt employed. This example also confirms that copper and cobalt will not interfere with arsenic removal and are, in fact, partially extracted by the salt.

TABLE II

| | Analysis % Ni | % Cu | % Co | % S | % As |
|---|---|---|---|---|---|
| Initial Matte | 66.8 | 0.51 | 0.62 | 31.6 | 0.091 |
| Final Matte | 69.4 | 0.41 | 0.30 | 31.5 | <0.002 |
| Final Salt | 7.9 | 0.34 | 0.95 | — | <0.002 |

EXAMPLE III

This example shows the refining of nickel matte with respect to antimony, bismuth, selenium, and tellurium as well as arsenic. Two parts of nickel matte having the composition given in Table III and one part of a salt mixture of 50% sodium chloride and 50% potassium chloride were heated to 800°C. and gaseous chlorine at a rate equivalent to 0.5 liter per kilogram of matte per minute was bubbled through the matte through a porous plug to provide good gas-liquid contact for 90 minutes. After termination of the chlorination treatment, the matte and the salt cover were analyzed and the analyses are given in Table III. The results in Table III confirm that chlorination of high sulfur nickel mattes is effective in refining nickel matte with respect to arsenic, antimony, bismuth, selenium and tellurium. The results in Table III also show that material amounts of copper, cobalt, lead, and zinc are simultaneously eliminated from the high sulfur nickel matte.

TABLE III

| | Analysis, Weight Per Cent Ni | Cu | Co | Pb | As | Sb | Bi | Se | Te | Zn | S |
|---|---|---|---|---|---|---|---|---|---|---|---|
| Starting Matte | 64.0 | 0.63 | 0.59 | 0.034 | 0.11 | 0.092 | 0.105 | 0.082 | 0.058 | 0.045 | 32.0 |
| Matte after 90 minute Chlorination | 63.1 | 0.35 | 0.12 | 0.0002 | 0.001 | <0.001 | 0.012 | 0.042 | 0.039 | 0.0015 | 32.7 |
| Salt after Chlorination | 15.4 | 0.34 | 0.67 | 0.032 | <0.001 | 0.002 | 0.022 | <0.01 | <0.005 | 0.065 | |

EXAMPLE IV

A process dust having the composition given in Table IV was mixed with elemental sulfur and was reduction smelted to produce a matte having the composition reported in Table IV. The resulting matte was provided with a fused calcium chloride salt cover such that the weight ratio of salt to matte was about 1.5. The matte and salt cover were maintained at 880°C. for varying lengths of time while gaseous chlorine at a rate of 7 kilograms per 100 kilograms of matte per hour was bubbled through the matte. Samples of the matte were taken at 30, 60 and 90 minute intervals and the samples were analyzed with the results being reported in Table IV.

The results presented in Table IV confirm that mattes produced by reduction smelting and sulfiding process dusts can be refined with respect to arsenic, antimony, bismuth, cobalt, copper, iron, lead, tellurium, and tin with arsenic, antimony, bismuth, iron, lead, tellurium and tin elimination being particularly significant.

TABLE IV

| | Chlorination Conditions Time, min. | $Cl_2$ 0.029 Wt % of Matte | Composition, Weight % Cu | Ni | Co | Fe | S | Pb | As | Te | Bi | Sn | Sb |
|---|---|---|---|---|---|---|---|---|---|---|---|---|---|
| Process dust[1] | — | — | 0.81 | 66.0 | 0.39 | 0.34 | 3.4 | 3.19 | 0.58 | 1.19 | 0.20 | 0.31 | 0.02 |
| Matte | 0 | 0 | 0.83 | 66.1 | 0.63 | 0.25 | 31.1 | 3.07 | 0.54 | 1.10 | 0.27 | 0.0009 | 0.018 |
| Matte | 30 | 3.5 | 0.48 | 66.2 | 0.45 | 0.07 | 31.2 | 0.025 | 0.047 | 0.76 | 0.10 | <0.0005 | <0.003 |
| Matte | 60 | 7.0 | 0.35 | 65.6 | 0.25 | 0.04 | 31.6 | 0.008 | 0.006 | 0.64 | 0.018 | <0.0005 | <0.003 |
| Matte | 90 | 10.5 | 0.29 | 67.1 | 0.18 | 0.04 | 31.8 | 0.006 | 0.003 | 0.58 | 0.004 | <0.0005 | <0.003 |
| Salt | 30 | 3.5 | 0.23 | 0.72 | 0.15 | 0.12 | — | 1.81 | 0.052 | <0.005 | 0.029 | <0.001 | <0.01 |
| Salt | 60 | 7.0 | 0.32 | 2.13 | 0.26 | 0.12 | — | 1.72 | 0.01 | <0.005 | <0.001 | <0.001 | <0.01 |
| Salt | 90 | 10.5 | 0.35 | 3.29 | 0.30 | 0.11 | — | 1.67 | | <0.005 | <0.001 | <0.001 | <0.01 |

[1]The Process dust also contained 0.47% $SiO_2$, 0.30% $Al_2O_3$, 0.31% CaO, 5.44% $SO_4$, and balance essentially combined oxygen.

It is to be noted that all solid and liquid compositions given herein are on a weight basis and gaseous compositions on a volumetric basis unless otherwise stated.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A process for refining nickel matte which comprises establishing a molten bath of nickel matte containing at least one impurity selected from the group consisting of antimony, arsenic, bismuth, selenium, and tellurium and at least about 28% sulfur and contacting the nickel matte with gaseous chlorine which reacts with the impurity to form a chloride that is volatilized from the nickel matte, thereby separating said impurity from the matte.

2. The process as described in claim 1 wherein the nickel matte is provided with a fused halide salt cover.

3. The process as described in claim 1 wherein the nickel matte contains between about 0.01% and 3% of the impurity.

4. The process as described in claim 1 wherein the nickel matte is maintained at a temperature below about 1000°C.

5. The process as described in claim 1 wherein the nickel matte is maintained at a temperature between about 750°C. and 1000°C.

6. The process as described in claim 1 wherein the nickel matte is maintained at a temperature between about 800°C. and 900°C.

7. The process as described in claim 1 wherein the nickel matte contains between about 30% and 32.5% sulfur.

8. The process as described in claim 1 wherein the nickel matte is provided with a fused salt cover of a solution of chlorides of at least two elements selected from the group consisting of sodium, potassium, lithium and calcium.

9. The process as described in claim 8 wherein the weight ratio of salt to matte is between about 1:20 and 2:1.

10. The process as described in claim 8 wherein the weight ratio of salt to matte is between about 1:20 and 1:1.

11. The process as described in claim 8 wherein the fused salt contains substantially equal parts of the chlorides of each element.

12. The process as described in claim 1 wherein a fused chloride salt cover is established over the nickel matte which salt dissolves chlorinated nickel values and the fused salt containing the nickel chloride is employed to extract at least one metal selected from the group consisting of cobalt, copper, iron, lead, tin and zinc from a sulfur-deficient matte.

13. The process as described in claim 12 wherein the fused salt containing the metal is, after removal from the sulfur-deficient matte, treated to precipitate the metal and is then returned to the chlorination step for chlorinating and volatilizing arsenic, antimony, bismuth, selenium, or tellurium from matte containing at least about 28% sulfur.

14. The process as described in claim 13 wherein the sulfur-deficient matte after being refined by the nickel-chloride-containing salt is treated with at least one reagent selected from the group consisting of elemental sulfur or hydrogen sulfide to increase the sulfur content of the matte to at least about 28%.

15. The process as described in claim 1 wherein the nickel matte is produced from nickeliferous sulfide ores.

16. The process as described in claim 1 wherein the nickel matte is produced from nickeliferous sulfide concentrates.

17. The process as described in claim 1 wherein the nickel matte is derived from the reduction smelting and/or sulfiding of nickeliferous lateritic ores.

18. The process as described in claim 1 wherein the nickel matte is produced by reductive smelting and/or sulfiding of nickeliferous process dusts.

19. The process as described in claim 1 wherein the nickel matte is produced by sulfiding metallurgical scrap or metallic precipitates.

20. The process as described in claim 1 wherein the nickel matte is produced by precipitating sulfides from aqueous solutions, which solutions are derived by leaching nickeliferous sulfide or oxide ores.

* * * * *